US006561902B1

(12) United States Patent
Walker et al.

(10) Patent No.: US 6,561,902 B1
(45) **Date of Patent: *May 13, 2003**

(54) METHOD AND APPARATUS FOR DIRECTING A GAME WITH USER-SELECTED ELEMENTS

(75) Inventors: Jay S. Walker, Ridgefield, CT (US); James A. Jorasch, Stamford, CT (US)

(73) Assignee: Walker Digital, LLC, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/722,761

(22) Filed: Nov. 27, 2000

Related U.S. Application Data

(63) Continuation of application No. 09/000,628, filed on Dec. 30, 1997, now Pat. No. 6,174,235.

(51) Int. Cl.[7] ..... A63F 9/24
(52) U.S. Cl. ..... 463/25; 463/20; 434/118
(58) Field of Search ..... 463/1, 12–13, 463/16–20, 25, 29–30, 36, 40–42; 273/138.1, 138.2, 139, 269, 236–237; 700/91, 93; 283/49, 51, 901, 903; 434/118

(56) References Cited

U.S. PATENT DOCUMENTS

| | | | | |
|---|---|---|---|---|
| 3,533,629 | A | 10/1970 | Raven | 273/138 |
| 3,770,269 | A | 11/1973 | Elder | 273/1 |
| 4,508,345 | A | 4/1985 | Okada | 273/143 |
| 4,560,161 | A | 12/1985 | Hamano | 273/85 |
| 4,624,462 | A | 11/1986 | Itkis | 273/237 |
| 4,648,600 | A | 3/1987 | Olliges | 273/138 |
| 4,684,128 | A | 8/1987 | Verstraeten | 273/1 |
| 4,695,053 | A | 9/1987 | Vazquez, Jr. et al. | 273/143 |

(List continued on next page.)

FOREIGN PATENT DOCUMENTS

| | | | |
|---|---|---|---|
| WO | WO 97/27569 | 7/1997 | G07F/17/34 |

OTHER PUBLICATIONS

Brochure: "Doors to Riches", Shuffle Master Gaming, Las Vegas, Nevada.

Ritter, Bill; "The Bottom Line"; Los Angeles Times; Business Section; Part 4; p. 2B; Col. 3; Financial Desk; May 28, 1985.

"Video Punchcards . . . " U.P.I., BC Cycle, May 13, 1985, Regional News Section.

*Primary Examiner*—Mark Sager
(74) *Attorney, Agent, or Firm*—Michael D. Downs

(57) ABSTRACT

An electronic gaming device defines a set of all possible elements of a game. For example, in a slot machine-type game, the set of possible elements includes the symbols for cherries, bell, bar, orange, plum and seven. The gaming device further generates a set of location assignments for each of the elements, and assigns a location to each element in accordance with the set of location assignments. The player is presented with the locations and prompted to select one or more locations, depending on the type of game. The displayed locations to select are typically arranged in one or more rows of possible selections. Typically, each of the possible selections is hidden or obscured until selected by the player. The player provides his selection(s), and at least one corresponding selection signal(s) are received by the gaming device. Each received selection signal indicates an element from the set of possible elements. The selected elements are displayed, either after each selection is made or after all selections are made. The gaming device evaluates an outcome of the game in accordance with the selected elements. Depending on the type of game, the outcome may or may not be based on the order in which the elements are selected. Since the player selects the elements, he is provided with an illusion of control over the outcome of the game.

8 Claims, 11 Drawing Sheets

U.S. PATENT DOCUMENTS

| | | | | |
|---|---|---|---|---|
| 4,756,531 | A | 7/1988 | DiRe et al. | 273/138 |
| 4,836,546 | A | 6/1989 | DiRe et al. | 273/138 |
| 5,118,109 | A | 6/1992 | Gumina | 273/139 |
| 5,178,395 | A | 1/1993 | Lovell | 273/238 |
| 5,192,076 | A | 3/1993 | Komori | 273/138 |
| 5,351,970 | A | 10/1994 | Fioretti | 273/439 |
| 5,393,057 | A | 2/1995 | Marnell, II | 273/85 |
| 5,411,271 | A | 5/1995 | Mirando | 273/434 |
| 5,630,586 | A | 5/1997 | Lowden | 273/138.2 |
| 5,631,947 | A | 5/1997 | Wittstein et al. | 379/59 |
| 5,639,088 | A | 6/1997 | Schneider et al. | 273/138.2 |
| 6,174,235 | B1 * | 1/2001 | Walker et al. | |

* cited by examiner

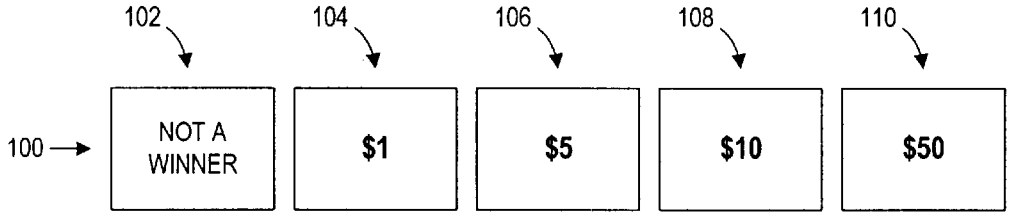
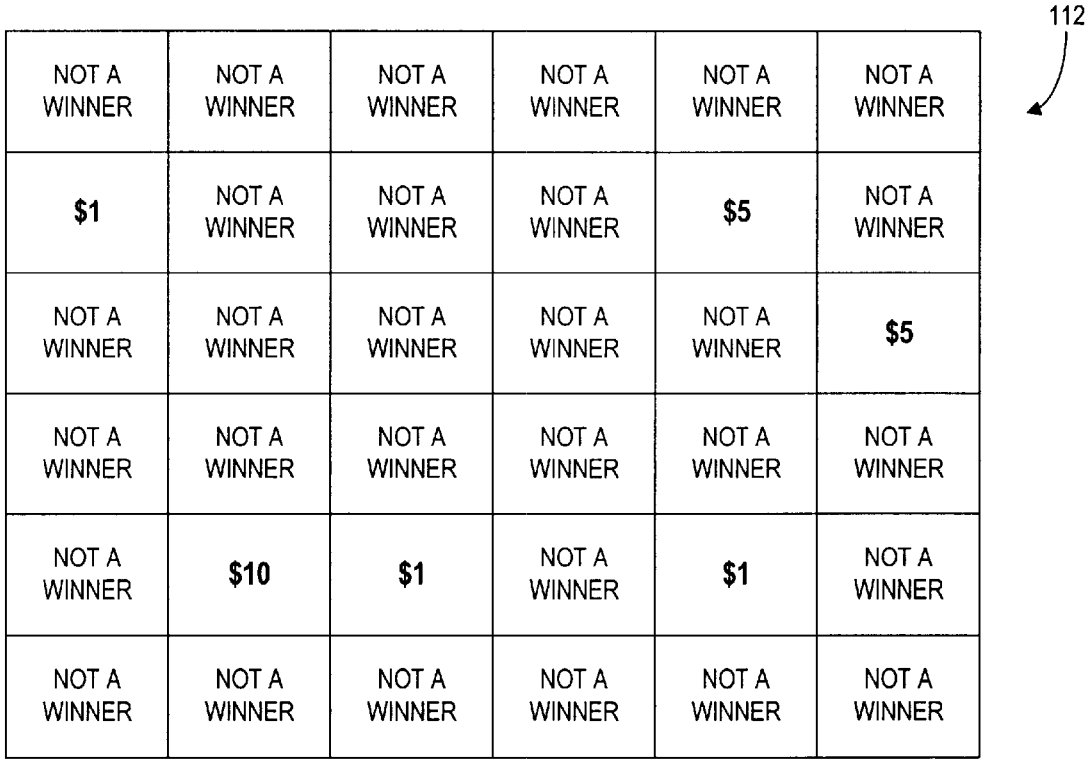
PRIOR ART
FIG. 4

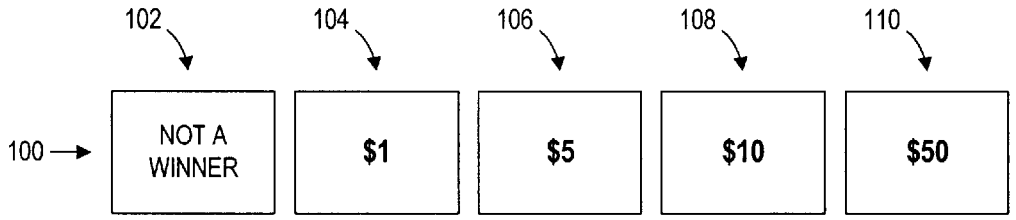
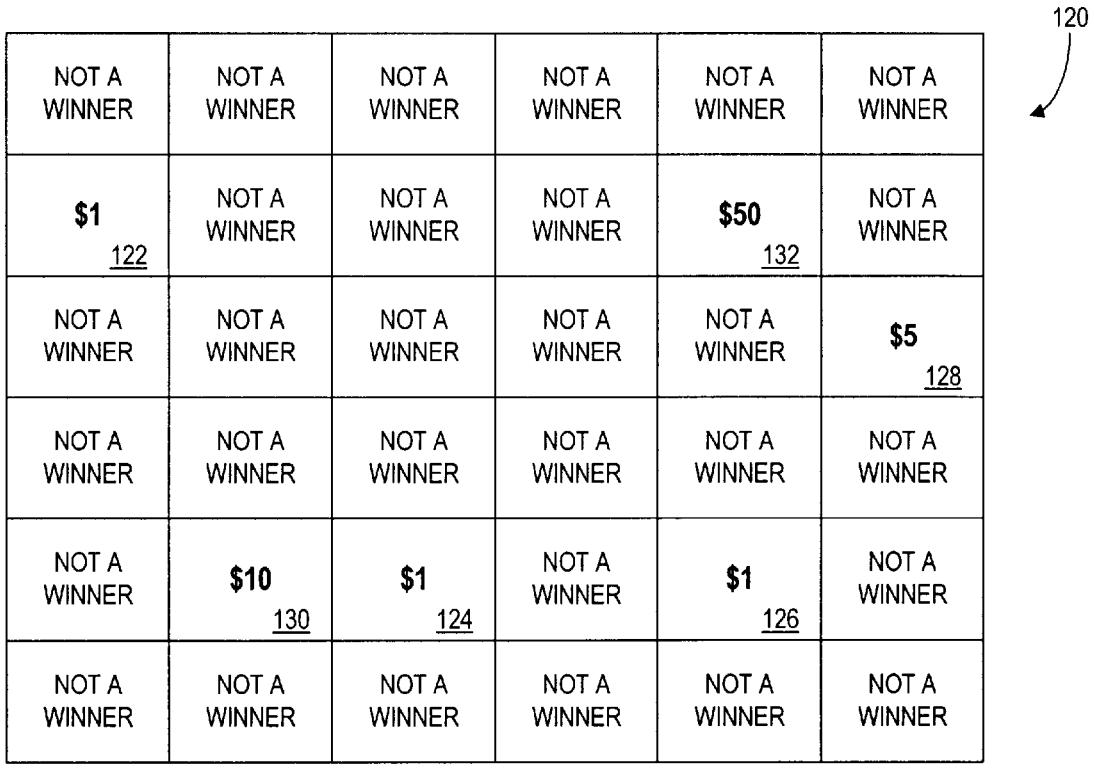
FIG. 5

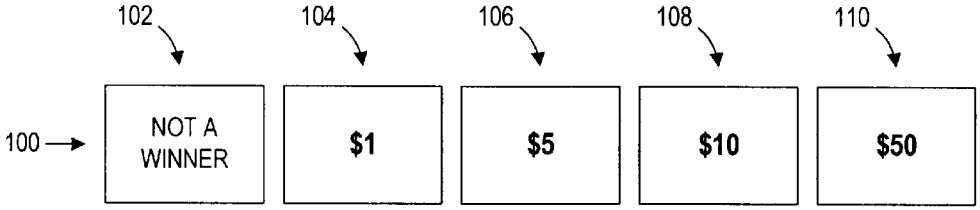

160

| ELEMENT | OCCURENCES |
|---|---|
| $50 | 1 |
| $10 | 2 |
| $5 | 3 |
| $1 | 5 |
| NOT A WINNER | 25 |

| 170 | 180 | 190 | 200 |
|---|---|---|---|
| $50 | 0.29 | 0.01 | NOT A WINNER |
| $10 | 0.67 | 0.02 | $10 |
| $10 | 0.02 | 0.12 | NOT A WINNER |
| $5 | 0.93 | 0.13 | NOT A WINNER |
| $5 | 0.33 | 0.14 | NOT A WINNER |
| $5 | 0.92 | 0.16 | NOT A WINNER |
| $1 | 0.62 | 0.17 | NOT A WINNER |
| $1 | 0.76 | 0.18 | NOT A WINNER |
| $1 | 0.93 | 0.19 | NOT A WINNER |
| $1 | 0.31 | 0.21 | NOT A WINNER |
| $1 | 0.26 | 0.21 | NOT A WINNER |
| NOT A WINNER | 0.59 | 0.23 | NOT A WINNER |
| NOT A WINNER | 0.69 | 0.26 | $1 |
| NOT A WINNER | 0.17 | 0.29 | $50 |
| NOT A WINNER | 0.90 | 0.31 | $1 |
| NOT A WINNER | 0.83 | 0.33 | $5 |
| NOT A WINNER | 0.19 | 0.33 | NOT A WINNER |
| NOT A WINNER | 0.51 | 0.48 | NOT A WINNER |
| NOT A WINNER | 0.01 | 0.49 | NOT A WINNER |
| NOT A WINNER | 0.93 | 0.51 | NOT A WINNER |
| NOT A WINNER | 0.16 | 0.59 | NOT A WINNER |
| NOT A WINNER | 0.49 | 0.62 | $1 |
| NOT A WINNER | 0.18 | 0.67 | $10 |
| NOT A WINNER | 0.98 | 0.69 | NOT A WINNER |
| NOT A WINNER | 0.21 | 0.71 | NOT A WINNER |
| NOT A WINNER | 0.33 | 0.73 | NOT A WINNER |
| NOT A WINNER | 0.23 | 0.76 | $1 |
| NOT A WINNER | 0.12 | 0.82 | NOT A WINNER |
| NOT A WINNER | 0.14 | 0.83 | NOT A WINNER |
| NOT A WINNER | 0.13 | 0.90 | NOT A WINNER |
| NOT A WINNER | 0.82 | 0.92 | $5 |
| NOT A WINNER | 0.71 | 0.93 | $1 |
| NOT A WINNER | 0.48 | 0.93 | NOT A WINNER |
| NOT A WINNER | 0.99 | 0.93 | $5 |
| NOT A WINNER | 0.21 | 0.98 | NOT A WINNER |
| NOT A WINNER | 0.73 | 0.99 | NOT A WINNER |

FIG. 7

210

| | | | | | |
|---|---|---|---|---|---|
| 1 | 7 | 13 | 19 | 25 | 31 |
| 2 | 8 | 14 | 20 | 26 | 32 |
| 3 | 9 | 15 | 21 | 27 | 33 |
| 4 | 10 | 16 | 22 | 28 | 34 |
| 5 | 11 | 17 | 23 | 29 | 35 |
| 6 | 12 | 18 | 24 | 30 | 36 |

220

| | | | | | |
|---|---|---|---|---|---|
| NOT A WINNER | NOT A WINNER | $1 | NOT A WINNER | NOT A WINNER | $5 |
| $10 | NOT A WINNER | $50 | NOT A WINNER | NOT A WINNER | $1 |
| NOT A WINNER | NOT A WINNER | $1 | NOT A WINNER | $1 | NOT A WINNER |
| NOT A WINNER | NOT A WINNER | $5 | $1 | NOT A WINNER | $5 |
| NOT A WINNER | NOT A WINNER | NOT A WINNER | $10 | NOT A WINNER | NOT A WINNER |
| NOT A WINNER | NOT A WINNER | NOT A WINNER | NOT A WINNER | NOT A WINNER | NOT A WINNER |

FIG. 8

METHOD AND APPARATUS FOR DIRECTING A GAME WITH USER-SELECTED ELEMENTS

CROSS REFERENCE TO RELATED APPLICATIONS

This application is a continuation of U.S. patent application Ser. No. 09/000,628, filed Dec. 30, 1997, now U.S. Pat. No. 6,174,235.

The present application is related to co-pending U.S. patent application Ser. No. 08/833,034, entitled METHOD AND APPARATUS FOR USING A PLAYER INPUT CODE TO AFFECT A GAMBLING OUTCOME, filed on Apr. 3, 1997.

FIELD OF THE INVENTION

The present invention relates to amusement devices, and more specifically to electronic chance devices.

BACKGROUND OF THE INVENTION

Many gamblers superstitiously believe that when they are feeling "lucky" they are sure to win. In casino games which allow players to add their personal input into the games, players often believe that their "lucky" feelings are transferred to the game and that they can therefore somehow "control" the outcome of the game. For example, in craps many players believe that their good luck is transferred into the throw of the dice. They may therefore blow on the dice before throwing them or even throw them with a certain force or in a certain manner. In blackjack, players often believe that cutting the cards at a certain location in the deck has an influence on whether they will win or lose. When players feel they can control the outcome of a game, they typically will continue to play that game, possibly for prolonged periods of time.

Of course, such efforts to "control" the outcome of these games are purely illusory, unless cheating is employed. However, it is this "illusion of control" that significantly adds to player enjoyment, and in many cases is a significant attraction of these games. Although the illusion of control is present in table games such as blackjack and craps, it is conspicuously absent from electronic gaming devices, such as slot machines and video poker. In an electronically-controlled slot machine, the player simply pushes a starter button or pulls a handle, and the machine in response randomly generates a sequence of symbols, thereby indicating an outcome for the game. Similarly, in an electronically-controlled video poker machine, the player simply pushes a button to have a hand dealt to him, and pushes a button to indicate which cards he would like to hold. The machine responds by randomly generating cards to replace those that are not held. In each case, the player does not provide any input or selection to influence what is randomly generated and provided (i.e. the symbols or card values). Thus, the player does not typically believe that he truly participates in or has any influence over the outcome of the game. He merely hopes for a winning result.

Since the 1970s, such electronic and electromechanical gaming devices have gained popularity in casinos. These devices include reel-bearing slot machines, video poker machines, video blackjack and video keno games. The outcomes of these gambling devices are solely microprocessor controlled. For example, pulling the handle or pushing a button to start an electronic reel-bearing slot machine simply activates a random number generator that generates a number corresponding to a reel position. The resultant reel position determines the amount of money ("payout") to the player. Some slot machines give a player an opportunity to stop each reel from spinning upon pressing a button. However, the machine generates a delay so that the reels do not immediately stop after the button is pressed. Thus, the player's perception of control over the outcome of the game remains minimal or nonexistent.

In video poker, although players are able to select which cards to hold and which cards to discard, the player has no control over which cards are dealt to him. Unlike blackjack, where a player can participate by cutting the cards, and can thereby influence the selection of cards dealt to him, no such option exists for video poker players. Accordingly, the player's perception of control over the outcome of the game remains minimal or nonexistent. Therefore, when he loses he may feel "trapped," thinking that no choice on his part could have resulted in a winning hand. If he feels too trapped after consecutive losses, he may stop playing in frustration.

PCT International Publication No. WO 97/27569, entitled INDICIA SELECTION GAME, International Publication Date Jul. 31, 1997, discloses a gaming system in which a player selects from a matrix of indicia locations, which may be represented by video simulations of overturned cards. However, this gaming system likewise does not offer a player many possible selections. For example, FIG. 2 of this publication shows fifteen elements to select. Accordingly, the player may feel trapped, and may even believe that the computer is selecting values that work against the player.

The game of Keno offers the player a chance to match a series of player-selected numbers against a series of numbers drawn by the Keno system. The player selects a series of numbers and the system then randomly generates the winning series of numbers. Thus, although players can select their "lucky" numbers, these selections have no impact on the winning numbers that are subsequently generated for the game. Since the winning series of numbers is generated only after the player has selected his numbers, the player often feels as if he cannot effectively influence or participate in whether he wins the game.

A common feature of electronic gaming devices is that a gambler can only hope that their "lucky" feelings are transferred into an object such as the "SPIN" button of an electronic slot machine or the "DEAL" button of a video poker machine. In other words, there is no relationship between the gambler's physical actions or choices and the outcome of the game. Because there is no way for the player to control the outcome of the machine, many players resort to searching for "lucky" machines. In a busy casino, however, there may be a limited number of machines available, and the player may consequently leave the casino.

Accordingly, there is a need to provide a player with an "illusion of control" of an electronic gaming device.

SUMMARY OF THE INVENTION

It is an object of the present invention to provide a player of a game of chance with an illusion of control through player selection of game elements.

In accordance with the present invention, an electronic gaming device defines a set of all possible elements of a game. For example, in a slot machine-type game, the set of possible elements includes the symbols for cherries, bell, bar, orange, plum and seven. In a card game, the set includes the fifty-two possible card values. In a punchboard-type game, the set includes various dollar amount values (various winning elements) and a "not a winner" element. The gaming device further generates a set of location assignments for each of the elements, and assigns one or more locations to each element in accordance with the set of location assignments.

The player is presented with the locations and prompted to select one or more locations, depending on the type of game. The displayed locations to select are typically arranged in one or more rows of possible selections. Typically, each of the possible selections is obscured until selected by the player. The player provides his selection(s), and the corresponding selection signal(s) are received by the gaming device. Each received selection signal indicates an element from the set of possible elements which has been selected. The selected element(s) are displayed, either after each selection is made or after all selections are made. The gaming device evaluates an outcome of the game in accordance with the selected element(s). Depending on the type of game, the outcome may or may not be based on the order in which the element(s) are selected.

BRIEF DESCRIPTION OF THE DRAWINGS

FIG. 4 is a diagrammatic representation of a set of all possible elements of a conventional punchboard-type game, and arrangement of those elements in a conventional punchboard-type game.

FIG. 5 is a diagrammatic representation of a set of all possible elements of a punchboard-type game, and arrangement of those elements in a punchboard-type game provided in accordance with the present invention.

FIG. 7 is a schematic illustration of elements generated and sorted for a game in accordance with the present invention.

FIG. 8 is a diagrammatic representation of elements which are assigned to locations to be selected.

DETAILED DESCRIPTION OF THE PREFERRED EMBODIMENTS

In accordance with the present invention, the player influences the outcome of a game by being able to select from among all possible elements of a game. Applicants have recognized that such an ability to select from all possible elements significantly increases player enjoyment due to an increased illusion of control. Since a player is able to select from among all possible elements of a game, he is able to obtain any possible outcome through appropriate selection. Thus, he is theoretically able to win a maximum payout each time he plays, thereby providing an illusion of control much greater than that provided by known electronic gaming devices.

Of course, the player's ability to select from among all possible elements does not necessarily change the probability of his winning or even his average payout. However, if he loses, he is less likely to blame the machine, and more likely to attribute the loss to his poor or "unlucky" selection. Thus, the player is more likely to continue playing.

As will be understood by those skilled in the art, the drawings and accompanying descriptions presented herein are exemplary arrangements for stored representations of information. A number of other arrangements may be employed besides the tables shown. Similarly, the illustrated entries represent exemplary information, but those skilled in the art will understand that the number and content of the entries can be different from those illustrated herein.

As will also be understood by those skilled in the art, a set of random numbers is an unpredictable sequence of numbers in which no number is any more likely to occur at a given time or place in the sequence than any other. Although truly random number generation is generally viewed as impossible, as used herein, the term "random number" will include the well-known process of generating random numbers with a computer ("pseudorandom number generation").

Figure 1:
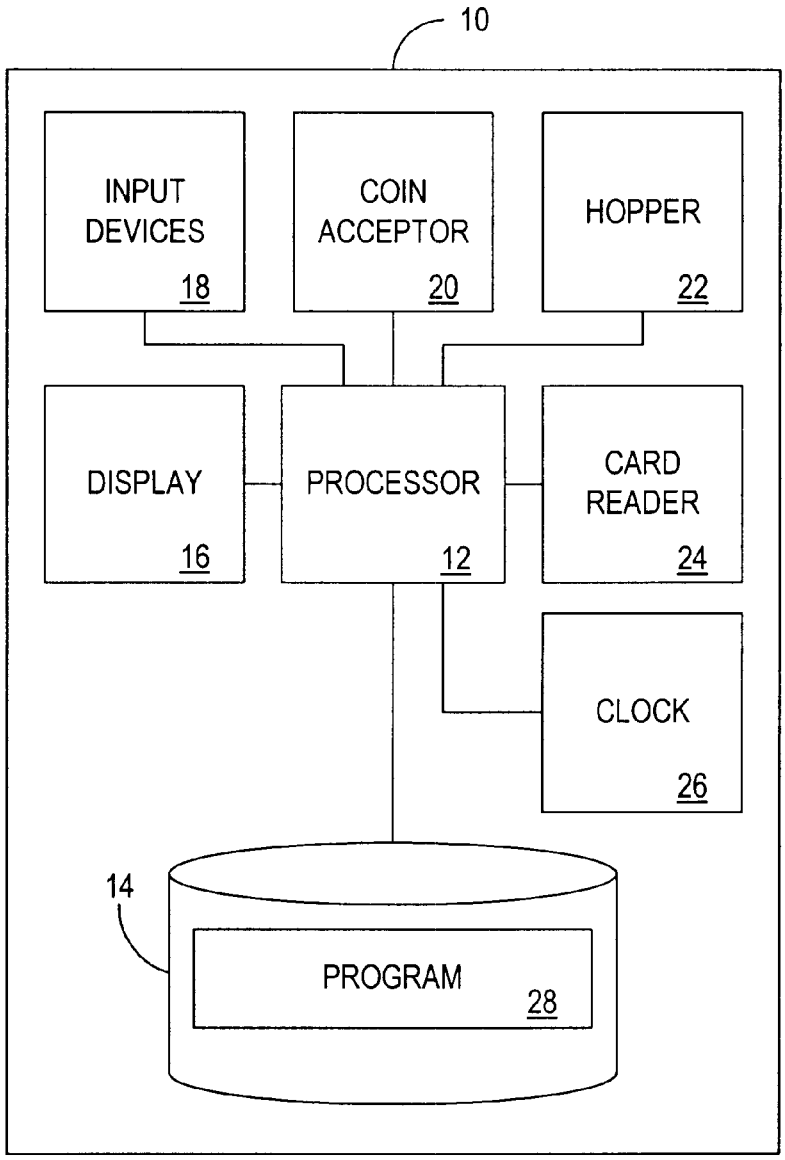
FIG. 1 is a schematic illustration of an electronic gaming device provided in accordance with the present invention.

Referring to FIG. 1, a gaming device 10 comprises a processor 12, such as one or more conventional microprocessors, which is in communication with a data storage device 14, such as an appropriate combination of magnetic, optical and/or semiconductor memory. The processor 12 and the storage device 14 may each be (i) located entirely within a single computer or other computing device; (ii) connected to each other by a remote communication link, such as a serial port cable, telephone line or radio frequency transceiver; or (iii) a combination thereof. For example, the gaming device 10 may comprise one or more computers which are connected to a remote server computer for maintaining databases.

The processor 12 is further in communication with a display 16 and player input devices 18. The display 16 is a graphical display device, such as a video monitor of a type used in conventional electronic gaming devices, for displaying images generated by the processor 12 during a game. Such images are described below. The player input devices 18 include input devices well known in the art, such as a touch screen for generating a signal indicative of a location on the touch screen that is touched or pressed by a player, and/or buttons which indicate player commands and selections when actuated. Other input devices will be understood by those skilled in the art.

The processor 12 is further in communication with a coin acceptor 20 for generating a signal indicative of the number of coins inserted and their type. The coin acceptor 20 thereby allows the processor 12 to determine an amount of funds which are deposited by a player and retained in a coin reservoir (not shown). A hopper 22 for dispensing coins from the coin reservoir (not shown) is in communication with the processor 12. When the player requests to "cash out" (receive all funds he is due), the processor determines if the player is due any funds ("credit"). If so, the processor 12 directs the hopper 22 to release an appropriate number and type of coins in a known manner.

The processor 12 is further in communication with a card reader 24 for reading information stored on a player tracking card (not shown). Such a player tracking card may be magnetically encoded with data representing an amount of funds, and/or with data representing a player identifier, such as a player name or account number. Accordingly, a player may use a player tracking card instead of inserting coins into and receiving coins from the gaming device 10. The player identifier can be used in accessing other player-related information stored on a network server or other remote device, as is described below. Thus, the card reader 24 also allows the processor 12 to receive and transmit player-related information. The card reader 24 may also include a display for displaying the value of funds stored in association with a player tracking card, thereby informing the player of an amount of funds available.

A clock 26 in communication with the processor 12 periodically generates signals that indicate time. Thus, the processor may ascertain the time of day or the time that has elapsed between two events.

The storage device 14 stores a program 28 for controlling the processor 12. The processor 12 performs instructions of the program 28, thereby operating in accordance with the present invention, and particularly in accordance with the methods described in detail herein. For example, the program 28 stores data indicative of game rules and elements. The program 28 furthermore includes program elements that may be necessary, such as an operating system and "device drivers" for allowing the processor to interface with computer peripheral devices, such as the hopper 22 and the card reader 24. Appropriate device drivers and other necessary program elements are known to those skilled in the art, and need not be described in detail herein.

In the above-described embodiment, the gaming device 10 is an electronic or electromechanical device similar to those installed in casinos. As such, the gaming device 10 would include typical components such as the coin acceptor 20, the hopper 22 and/or the card reader 24. In another embodiment, the gaming device 10 may be implemented as software that directs one or more computers, such as conventional personal computers based on Intel Pentium® microprocessors. Furthermore, such software implementations of the gaming device 10 may be operative to implement gaming over networks, such the Internet.

Figure 2:
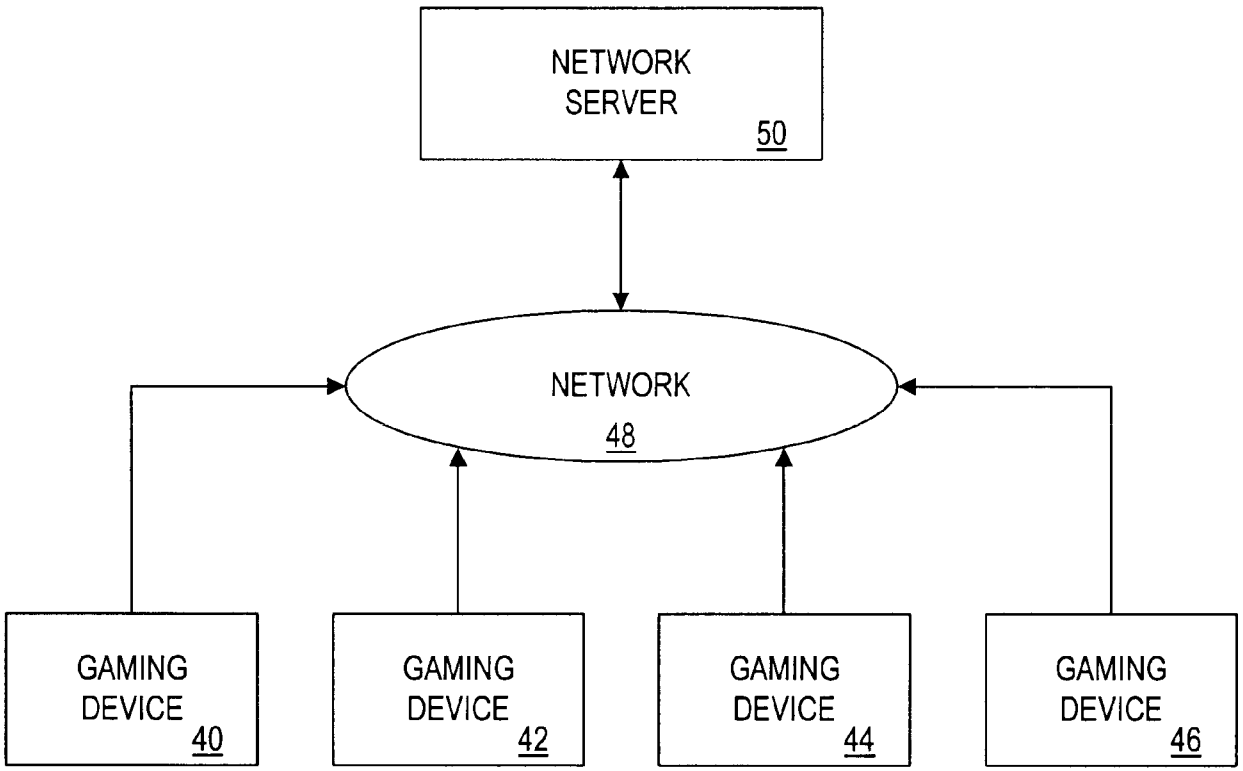
FIG. 2 is a schematic illustration of a plurality of gaming devices which are in communication with a network server.

Referring to FIG. 2, each of gaming devices 40, 42, 44 and 46 is in communication with a network 48, and is thereby in communication with a network server 50. Communication with the network server 50 allows each gaming device to access player-related information stored on the network server. Those skilled in the art will understand that many types of player-related information may be stored, such as funds and predefined game preferences. Those skilled in the art will also understand that many types of gaming devices may operate in communication with a network server, while many others may operate without any such communication to another device.

Many games are characterized by a plurality of elements. Selection of one or more of these elements (a subset of elements) determines an outcome of the game. In accordance with the present invention, every time a player plays the game he is allowed to select from a set that includes each possible element of the game. Thus, the ability to select any element, and thereby to attain the highest-value outcome, is in the control of the player every time he plays.

Figure 3:
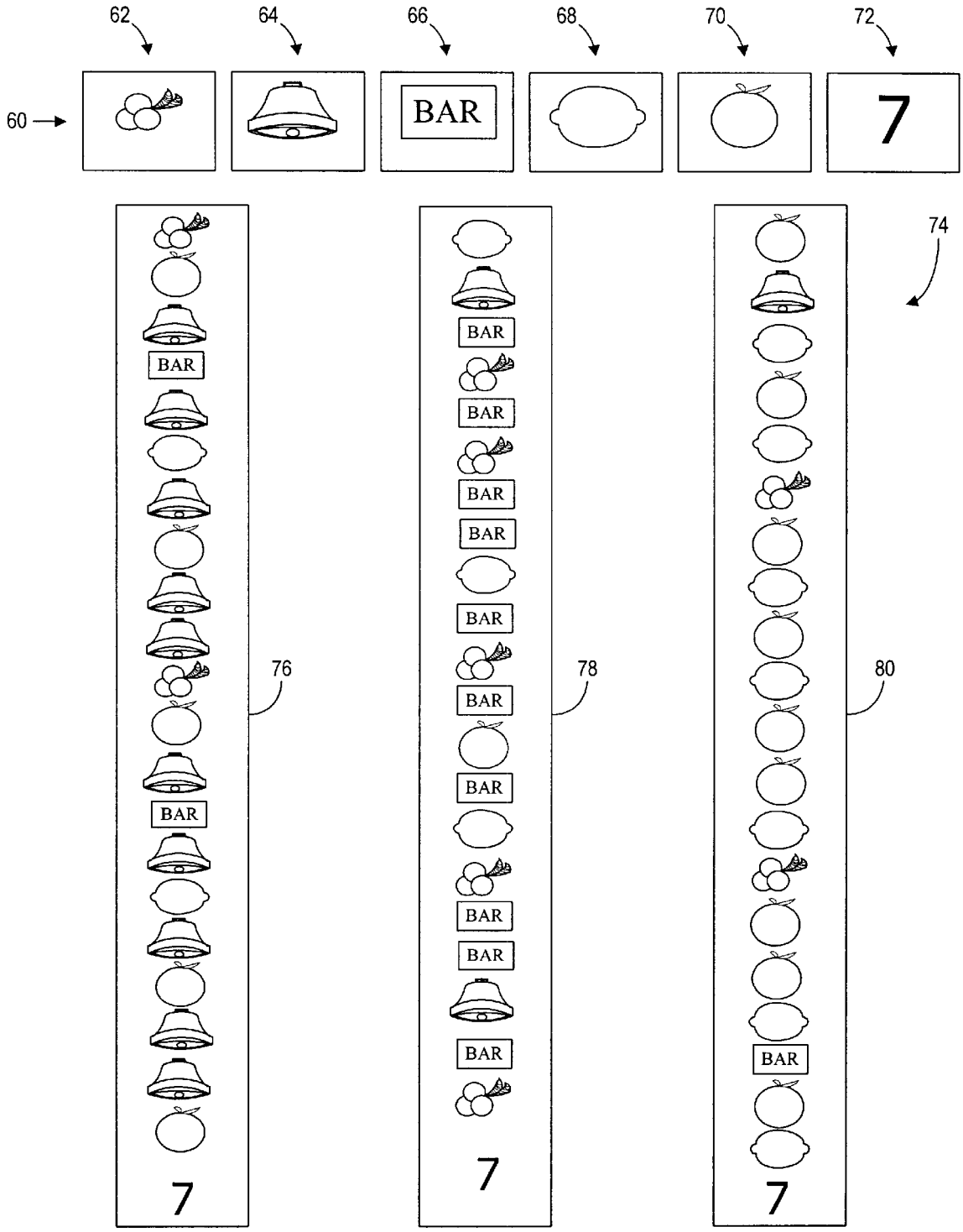
PRIOR ART FIG. 3
FIG. 3 is a diagrammatic representation of a set of all possible elements of a conventional slot machine-type game, and arrangement of those elements in a conventional slot machine-type game.

Referring to FIG. 3, a set 60 of elements includes all possible elements of a conventional slot machine-type game. The set 60 includes a cherries element 62, a bell element 64, a bar element 66, an orange element 68, a plum element 70 and a seven element 72. During a game, the device randomly selects one element from each of a plurality of reels, yielding a subset of elements that defines the outcome for that game. For example, one possible subset is a bar element, a plum element and a bell element. Another possible subset is an orange element and two cherries elements.

For each reel in a conventional slot machine-type game, the selected element may be one of twenty-two equally likely choices, each choice being one of the set 60 of all possible elements. For example, a plurality 74 of reels includes reels 76, 78 and 80. In a conventional slot machine-type game, the player is randomly provided with, but does not select, an element chosen from each of the reels 76, 78 and 80, thereby yielding a subset that consists of three elements. The three elements define the outcome, and therefore a payout. However, because the player does not select any elements, he lacks the illusion of control which makes the game more desirable.

It is noted that the number of choices in a game is greater than the number of elements. For example, although there are six elements 62, 64, 66, 68, 70 and 72, there are twenty-two choices on each reel, and therefore there are 10,648 possible outcomes for each game (22×22×22=10,648).

Referring to FIG. 4, a set 100 of elements includes all possible elements of a conventional punchboard-type game. The set 100 includes a "not a winner" element 102, a $1 element 104, a $5 element 106, a $10 element 108 and a $50 element 110. In this type of game, each element corresponds to an outcome (i.e. a dollar value won, if any). Thus, each element defines an outcome, and the set 100 therefore includes all possible outcomes of the game. During a conventional punchboard-type game, the player selects one element from a plurality of randomly-generated possible selections 112, yielding an element that defines the outcome and payout for that game. Of course, each of the possible selections 112 is typically hidden or obscured until selected by the player. It is noted that although there are five elements 102, 104, 106, 108 and 110, the plurality of possible selections 112 includes thirty-six possible choices. Thus, a player indicates which of the thirty-six locations he selects, and the element corresponding to the selected location defines the outcome. Unfortunately, in the exemplary plurality of possible selections 112, not all possible elements are included. In particular, there is no element representing the maximum payout ($50 element 110). Accordingly, the player could not possibly attain the maximum payout in a conventional game corresponding to the example illustrated by the plurality of possible selections 112.

In summary, for each game there is defined a set of elements. In conventional electronic gaming devices, such as illustrated by FIGS. 3 and 4, which allow a player to select elements, the player may only select from a group that does not contain all possible elements of a game. The player thus does not significantly enjoy the illusion of control, and may feel that a loss is predetermined. By contrast, in the present invention the set from which the player selects includes all possible outcomes of a game.

Referring to FIG. 5, the set 100 of all possible elements of a punchboard-type game is illustrated again. In addition, each of a plurality of locations 120 defines a possible selection. The plurality of locations 120 includes each element of the set 100 of all possible elements, and so each element of the set 100 may be selected by a player. In accordance with the present invention, each of the elements 102, 104, 106, 108 and 110 is assigned to at least one of the plurality of locations 120. For example, the $1 element 104 is assigned to locations 122, 124 and 126, the $5 element 106 is assigned to location 128, the $10 element 108 is assigned to location 130, the $50 element 110 is assigned to location 132 and the "not a winner" element 102 is assigned to the remaining locations in the plurality of locations 120. The assignment of each possible element to at least one location is random, and is described in detail below. A player selects one element from the plurality of locations 120 by operating one or more of the player input devices 18 (FIG. 1).

Figure 6:
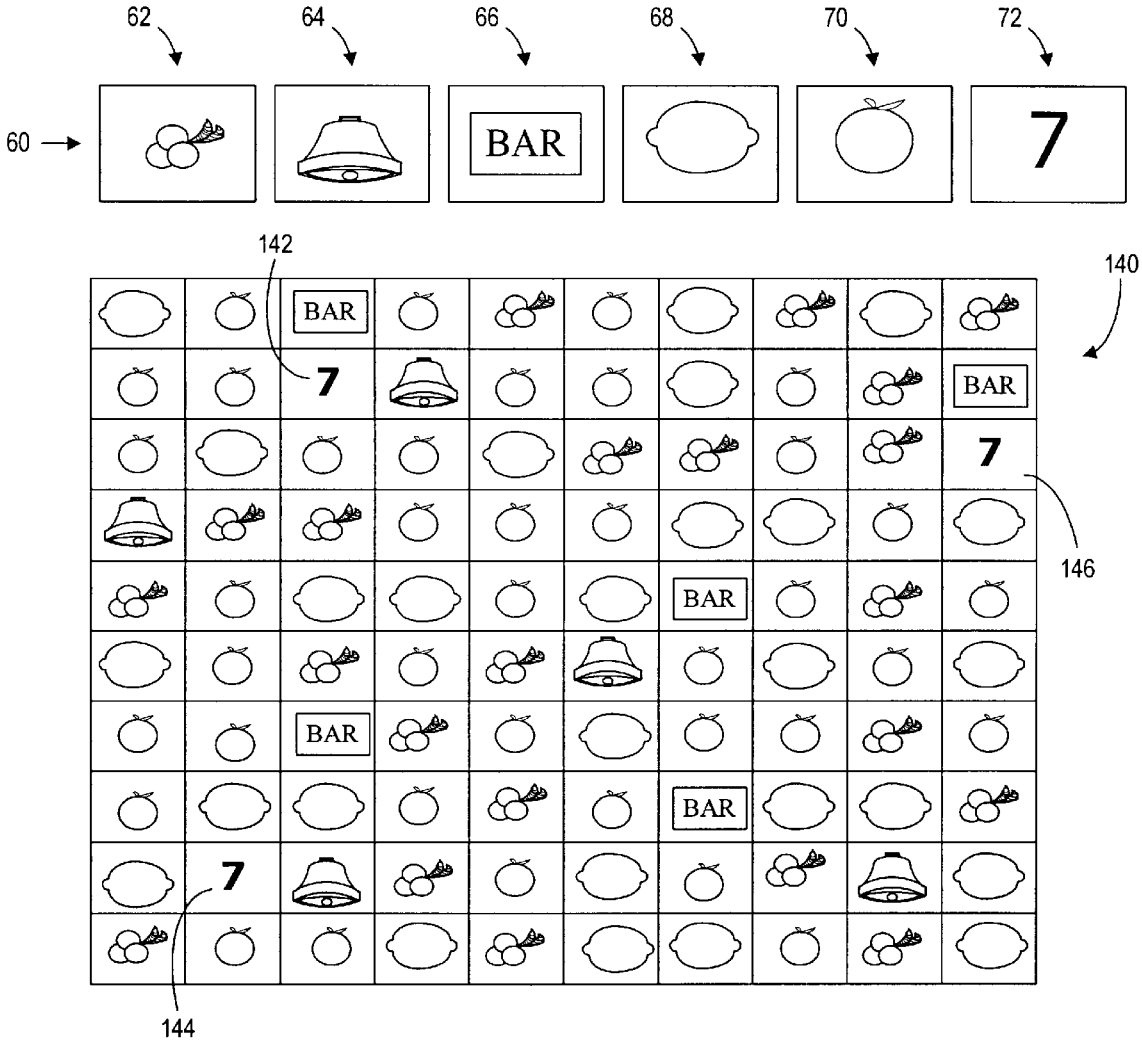
FIG. 6 is a diagrammatic representation of a set of all possible elements of a slot machine-type game, and arrangement of those elements in a slot machine-type game provided in accordance with the present invention.

Referring to FIG. 6, the set 60 of all possible elements of a slot machine-type game is illustrated again. In addition, each of a plurality of locations 140 defines a possible selection. In accordance with the present invention, each of the elements 62, 64, 66, 68, 70 and 72 is assigned to at least one of the plurality of locations 140. In particular, the seven element 72 is assigned to locations 142, 144 and 146. During each game, the player selects three locations from the plurality of locations 140, thereby defining a subset of three elements that defines the outcome and payout for that game. Of course, each of the plurality of locations 140 is hidden or obscured until selected by the player. In the example illustrated by FIG. 6, during every game the player has a 0.0006% chance of selecting the three "seven" elements (3/100×2/99×1/98 6/970,200=0.000006).

FIG. 7 illustrates one method for randomly assigning each possible element to at least one location in a punchboard-type game provided in accordance with the present invention. In particular, the method illustrated by FIG. 7 assigns each element of the set 100 to at least one of thirty-six locations. The gaming device 10 (FIG. 1) first generates a table 160 that defines, for the thirty-six locations, a number of occurrences of each element of the set 100. Accordingly, the sum of the occurrences of each element is thirty-six.

A series 170 of thirty-six elements is generated in accordance with the table 160. The series 170 thereby defines the occurrences of each element of the set 100. The gaming device 10 (FIG. 1) also generates a series 180 of random numbers which are used to define the assignment of each of the elements of the series 170 to a location. Each random number of the series 180 indicates a location of the corresponding element of the series 170. For example, the first random number of the series 180 defines the position of the first element of the series 170 in a manner described below.

The gaming device generates a series 190, which is a sorted series of the random numbers of the series 180. The sorted series 190 thereby also defines a sorted series 200 of elements. The sorted series of elements 200 correspond to the series 170 which has been sorted in accordance with the order of the sorted series 190 of random numbers, thereby maintaining the correspondence between elements and random numbers defined by the series 170 and 180. Thus, just as each random number of the series 180 corresponds to an element of the series 170, a matching random number may be found in the series 190 in correspondence with a matching element in the series 190. For example, in the series 180, the first-listed random number 0.29 corresponds to the first element $50. Accordingly, the random number 0.29 in the series 190 also corresponds to the element $50.

Furthermore, each element of the sorted series 200 of elements corresponds to a location. For example, the first element of the sorted series 200 corresponds to a first location, and the thirty-sixth element of the sorted series 200 corresponds to a thirty-sixth location. Referring to FIG. 8, a table 210 defines a set of thirty-six locations that appear on the display 16 (FIG. 1), and which represent the possible choices from which a player selects an element in a punchboard-type game. Each location is numbered in accordance with the numbering shown in the table 210. In particular, the table 210 illustrates that the player is presented with a six-by-six array of possible choices. The gaming device associates each location with the corresponding element of the sorted series 200 of elements, thereby defining a table 220 of elements assigned to the thirty-six locations. For example, if the player selects the element in the second row and the third column (location number fourteen), he selects the $50 element. The fourteenth element of the series 200 is the $50. As described above, each of the thirty-six locations is obscured until selected by the player, although the table 220 shows each element.

Figure 9:
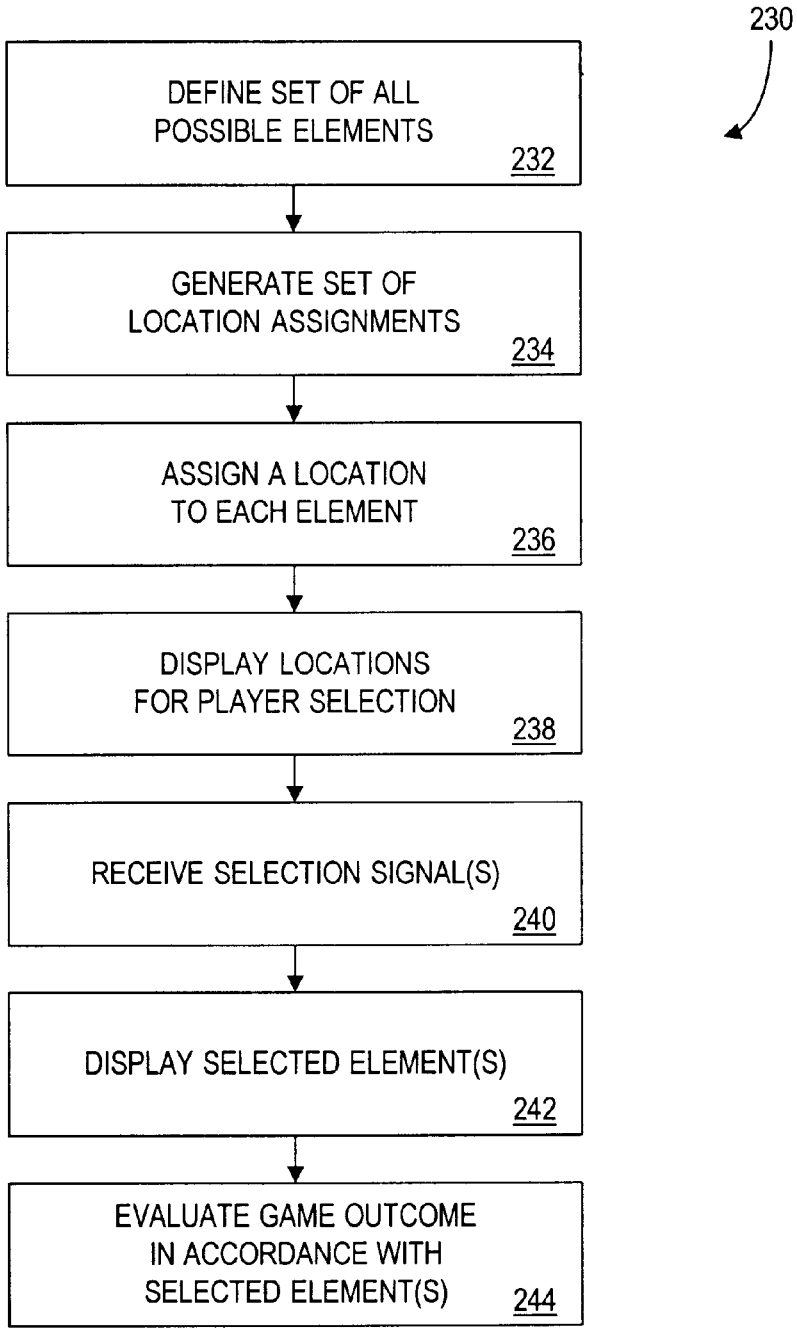
FIG. 9 is a flow chart illustrating a method in accordance with the present invention for directing a game.

Referring to FIG. 9, a method 230 initiates with the electronic gaming device 10 (FIG. 1) defining a set of all possible elements of a game (step 232). This set may be defined in many known ways. Typically, the gaming device 10 defines the set by storing a table of elements and corresponding graphical representations, and further storing rules defining the occurrence rate of each element. The gaming device 10 further generates a set of location assignments for each of the elements (step 234), and assigns a location to each element in accordance with the set of location assignments (step 236). The player is presented with locations and prompted to select one or more locations, depending on the type of game (step 238). The player may also be presented with game hints (predetermined text which depends on the status of each game), possibly for a fee (extra payment) or in return for a "preferred player" status indicated by the network server 50 (FIG. 2). The displayed locations to select are typically arranged in one or more rows of possible selections. Alternatively, the displayed locations to select may be represented as a three-dimensional layout. Furthermore, although typically each of the possible selections is hidden or obscured until selected by the player, it may be desirable to temporarily reveal some or all elements to the player before his selection is made, thereby introducing the player's memory ability into the game.

The player provides his selection(s) via one or more of the input devices 18 (FIG. 1), and one or more corresponding selection signals are received by the gaming device 10 (step 240). In an embodiment where elements are revealed to the player, the gaming device 10 may require that selection(s) are provided within a predetermined time of the revealing. In an alternate embodiment, the player has predefined selections that are stored on the network server 50 (FIG. 2). In such an embodiment, the selection signals would be transmitted from the network server 50 and received by the gaming device 10. Each received selection signal indicates an element from the set of possible elements. The selected elements are displayed (step 242), either after each selection is made, or after all selections are made. The gaming device 10 evaluates an outcome of the game in accordance with the selected elements (step 244). Such evaluation may be performed by comparing the selected elements with predefined subsets, each predefined subset defining a predefined outcome. Thus, the gaming device 10 can determine an outcome that corresponds to a predefined outcome (e.g. a $10 payout). For example, in a slot machine-type game, such as illustrated by FIG. 6, a predefined subset consisting of three instances of the seven element 72 (FIG. 6) may define an outcome comprising one hundred thousand times the amount wagered. In a poker-type game, a predefined subset consisting of four cards of equal rank may define an outcome comprising twenty five times the amount wagered. In addition, depending on the type of game, the outcome may or may not be based on the order in which the elements are selected.

It is noted that the above-description of element selection is applicable to many types of games, such as games in which each element represents a playing card value. As is known in the art, a card value is defined by a rank (2 through 10, jack, queen, king or ace) and suit (clubs, spades, diamonds or hearts). Accordingly, there are at least fifty-two possible elements in a game which employs playing cards (13 ranks×4 suits=52 card values).

Thus, a video poker-type game provided in accordance with the present invention may deal a player a hand of five cards, and allow the player to indicate which cards he wishes to hold. The cards not so indicated are discarded, and the player is allowed to select replacement cards from a set of the remaining forty-seven cards (52 cards in the deck−5 dealt cards=47 remaining cards). Alternatively, the player's initial five-card hand may be selected by the player in a like manner. Similarly, in a blackjack-type game provided in accordance with the present invention, the player is presented with a choice of the fifty two cards from which to select. Two are dealt to the dealer, and from the remaining fifty cards the player selects two cards for his hand. In accordance with the rules of blackjack, the player may select additional cards from those remaining cards. The player thus effectively deals to himself, providing an illusion of control greater than that of video or table blackjack. In another embodiment, the player may select the two cards which the dealer initially receives.

Figure 10:
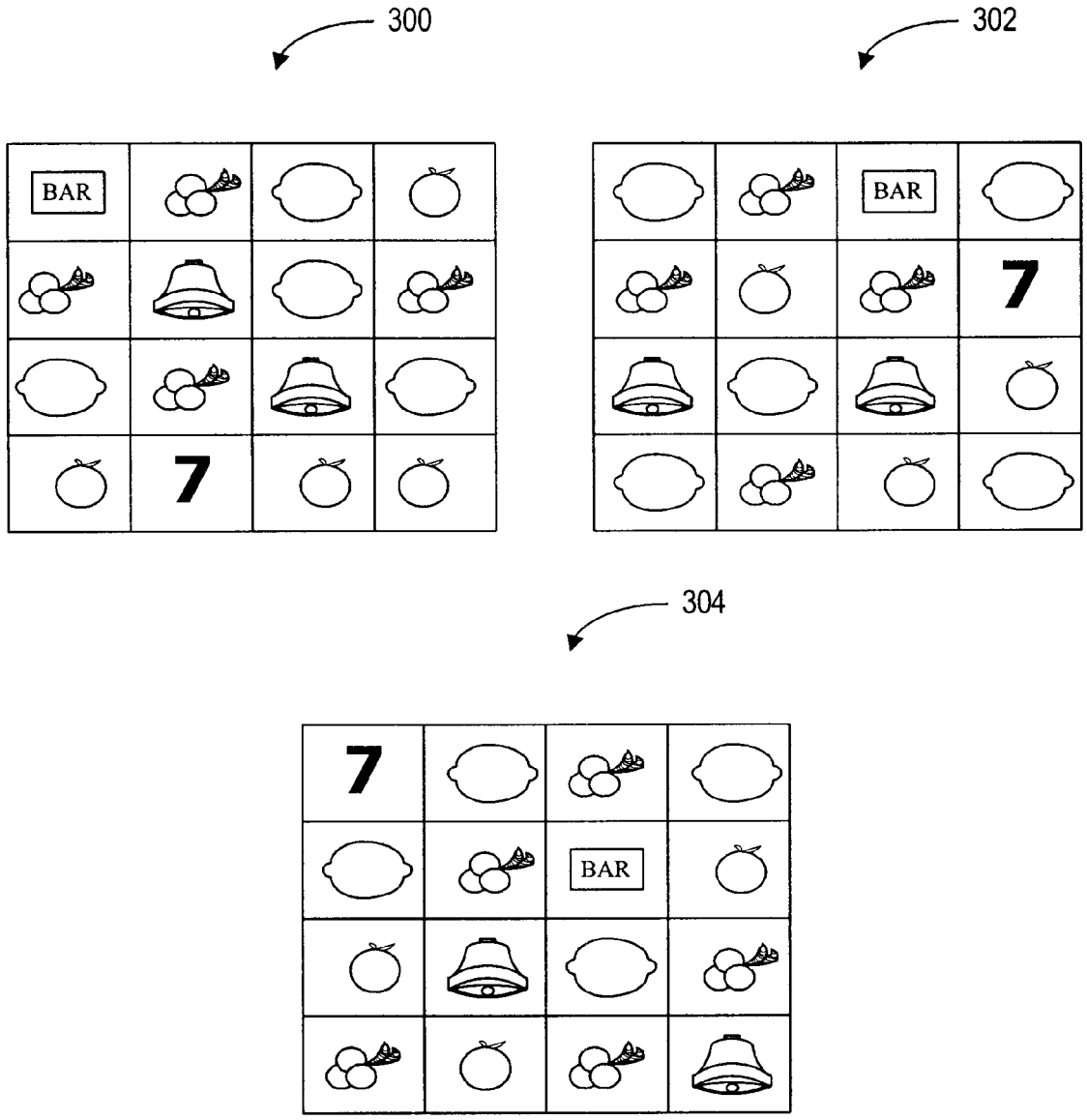
FIG. 10 is a diagrammatic representation of another arrangement of all possible elements in a slot machine-type game provided in accordance with the present invention.

Referring to FIG. 10, another embodiment of the present invention is described. Groups 300, 302 and 304 of possible selections are displayed, each set including all possible elements. The player selects at least one element from each of the groups 300, 302 and 304. For example, in a slot machine-type game, one symbol would be selected from each group, yielding three selected symbols. The outcome of the game would, in turn, be evaluated in accordance with the three selected symbols.

Figure 11:
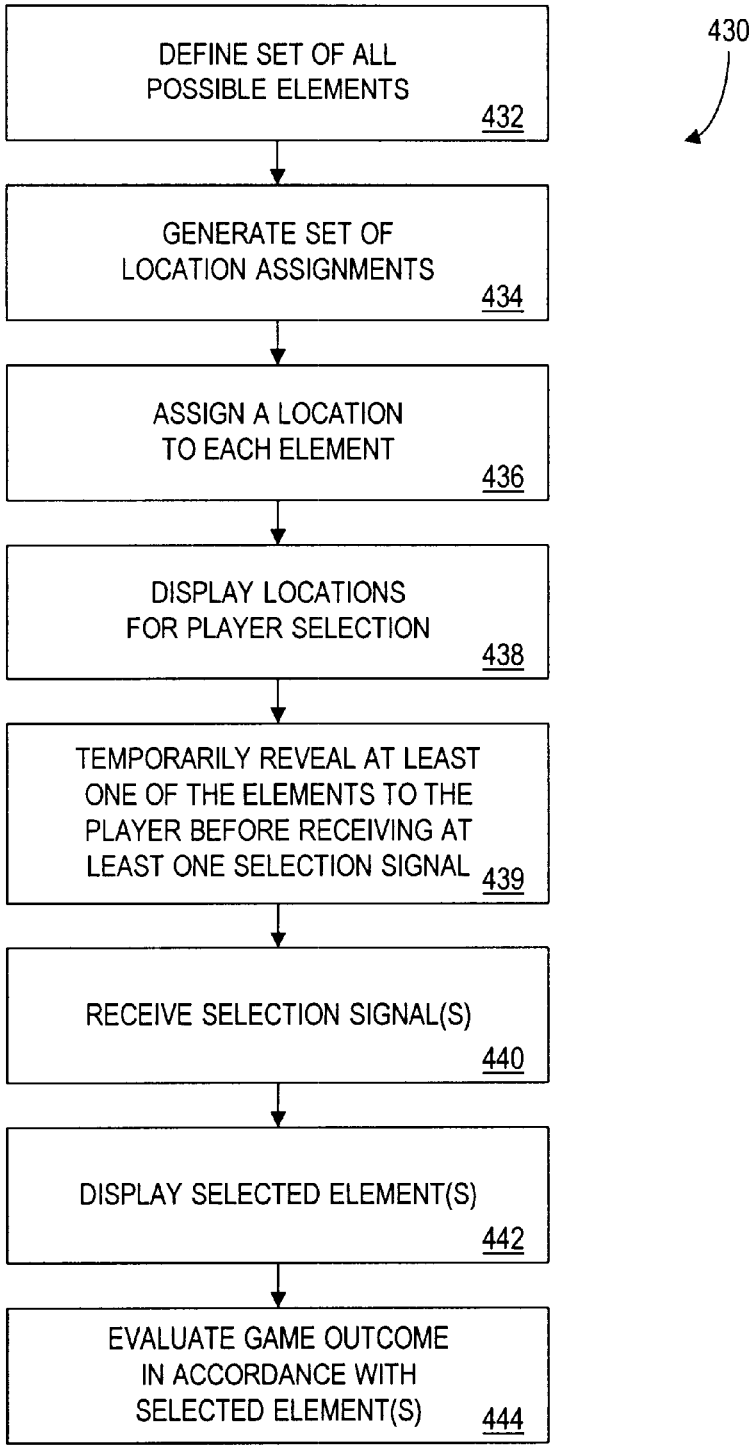
FIG. 11 is a flow chart illustrating a method in accordance with one or more embodiments of the present invention for directing a game.

Referring to FIG. 11, a method 430 initiates with the electronic gaming device 10 (FIG. 1) defining a set of all possible elements of a game (step 432). The gaming device 10 further generates a set of location assignments for each of the elements (step 434), and assigns a location to each element in accordance with the set of location assignments (step 436). The player is presented with locations and prompted to select one or more locations, depending on the type of game (step 438). At least one of the elements is temporarily revealed to the player before at least one selection signal is received (step 439).

The player provides his selection(s) via one or more of the input devices 18 (FIG. 1), and one or more corresponding selection signals are received by the gaming device 10 (step 440). Each received selection signal indicates an element from the set of possible elements. The selected elements are displayed (step 442), either after each selection is made, or after all selections are made. The gaming device 10 evaluates an outcome of the game in accordance with the selected elements (step 444).

Although the present invention has been described with respect to a preferred embodiment thereof, those skilled in the art will note that various substitutions may be made to those embodiments described herein without departing from the spirit and scope of the present invention. For example, although the above-described embodiments illustrate that the gaming device evaluates an outcome of the game in accordance with the selected elements, the outcome may further depend on other randomly-generated data. For example, the gaming device may generate one or more cards, the player may select one or more additional cards from those remaining, and then the gaming device would evaluate an outcome in accordance with all selected cards. Alternatively, the gaming device may randomly generate a subset of elements to determine a base payout, and the player selects an additional element which determines a multiplier on the base payout. In addition, other types of games, such as bingo and keno, are also anticipated by the disclosure of the present invention.

What is claimed is:

1. A method for directing a wagering game playable by a player, the method comprising:

defining a set of elements, the set including all possible elements of the wagering game;

assigning each of the elements of the wagering game to at least one of a plurality of locations, therein defining a set of all possible locations;

displaying an image of the set of all possible locations to the player;

receiving at least one selection signal, each selection signal indicating a location from the set of all possible locations which has been selected by the player, the at least one selection signal thereby indicating at least one selected element; and evaluating an outcome of the wagering game in accordance with the at least one selected element;

wherein the image is displayed such that at least one of the elements is temporarily revealed to the player before receiving the at least one selection signal.

2. The method of claim 1, wherein the step of receiving at least one selection signal includes receiving a plurality of selection signals sequentially.

3. The method of claim 2, further comprising displaying each selected element after a corresponding selection signal is received.

4. The method of claim 1, wherein each of the elements is selected from the group consisting of a cherries element, a bell element, a bar element, an orange element, a plum element, and a seven element.

5. An apparatus for directing a wagering game playable by a player, the apparatus comprising:

a storage device; and a processor connected to the storage device;

the storage device storing a program for controlling the processor; and the processor operative with the program to define a set of elements, the set including all possible elements of the wagering game;

assign each of the elements of the wagering game to at least one of a plurality of locations, thus defining a set of all possible locations;

display an image of the set of all possible locations to the player;

receive at least one selection signal, each selection signal indicating a location from the set of all possible locations which has been selected by the player, the at least one selection signal thereby indicating at least one selected element; and evaluate an outcome of the wagering game in accordance with the at least one selected element;

wherein the processor is further operative to display the image such that at least one of the elements is temporarily revealed to the player before receiving the at least one selection signal.

6. The apparatus of claim 5, wherein the processor is further operative to receive a plurality of selection signals sequentially.

7. The apparatus of claim 6, wherein the processor is further operative to display each selected element after a corresponding selection signal is received.

8. The apparatus of claim 5, wherein each of the elements is selected from the group consisting of a cherries element, a bell element, a bar element, an orange element, a plum element, and a seven element.

* * * * *